United States Patent [19]

Doyel

[11] 4,334,678

[45] Jun. 15, 1982

[54] EXERCISER

[76] Inventor: John S. Doyel, 404 W. 20th St., New York, N.Y. 10011

[21] Appl. No.: 19,916

[22] Filed: Mar. 12, 1979

Related U.S. Application Data

[63] Continuation-in-part of Ser. No. 901,183, Apr. 28, 1978, abandoned.

[51] Int. Cl.[3] ..... A63B 21/00

[52] U.S. Cl. ..... 272/141; 272/142; 272/DIG. 5

[58] Field of Search ..... 272/116, 126, 130, 131, 272/134–138, 141–143, 125, DIG. 5; 124/16, 23 R, 24 R, 25, 26, 88, 91; 73/379

[56] References Cited

U.S. PATENT DOCUMENTS

| | | | |
|---|---|---|---|
| 428,912 | 5/1890 | Holmes | 124/23 R |
| 1,680,901 | 8/1928 | Meyer | 272/142 X |
| 2,261,173 | 11/1941 | Maxwell | 272/136 |
| 2,351,734 | 6/1944 | Backe | 124/23 R X |
| 2,356,260 | 8/1944 | Maxwell | 272/136 |
| 2,529,347 | 11/1950 | Mohler et al. | 272/135 |
| 3,204,955 | 9/1965 | Quire et al. | 272/125 |
| 3,268,225 | 8/1966 | Kolbel | 272/135 |
| 3,331,720 | 7/1967 | Watson | 124/91 X |
| 3,343,837 | 9/1967 | Grzybowski | 272/137 |
| 3,349,621 | 10/1967 | Mullen | 272/141 X |
| 3,510,130 | 5/1970 | Ferdinand | 272/67 |
| 3,814,074 | 6/1974 | Wood | 124/88 X |
| 3,843,119 | 10/1974 | Davis | 272/125 X |
| 3,877,611 | 4/1975 | Morrison | 124/23 R X |
| 3,958,803 | 5/1976 | Geisselbrecht | 272/135 |
| 3,971,255 | 7/1976 | Varney et al. | 73/379 |
| 4,059,265 | 11/1977 | Wieder | 272/137 |
| 4,089,520 | 5/1978 | Ozbey et al. | 272/136 |

FOREIGN PATENT DOCUMENTS

| | | | |
|---|---|---|---|
| 805029 | 1/1969 | Canada | 272/135 |
| 448275 | 8/1927 | Fed. Rep. of Germany | 272/136 |
| 2548713 | 5/1976 | Fed. Rep. of Germany | 272/136 |

*Primary Examiner*—Richard J. Apley

*Attorney, Agent, or Firm*—Cooper, Dunham, Clark, Griffin & Moran

[57] ABSTRACT

Disclosed is a spring loaded exerciser in the shape of a bow made up of a central bar and two arms extending from the ends of the central bar and pivotally connected to it and a cord connecting the free ends of the arms. There may be a gauge to indicate the degree of force exerted by the user, and there may be sliding handles on the cord. The exerciser is made primarily of light-weight, inexpensive, molded plastic material. In one embodiment, there is a compression spring at the pivotal connection of each arm to the central bar which resists movement of the arms toward each other. In another, there is a tension spring at the pivotal connection of each arm to the central bar which resists movement of the arms toward each other, and the bow-shape is somewhat different.

1 Claim, 7 Drawing Figures

Fig. 1.
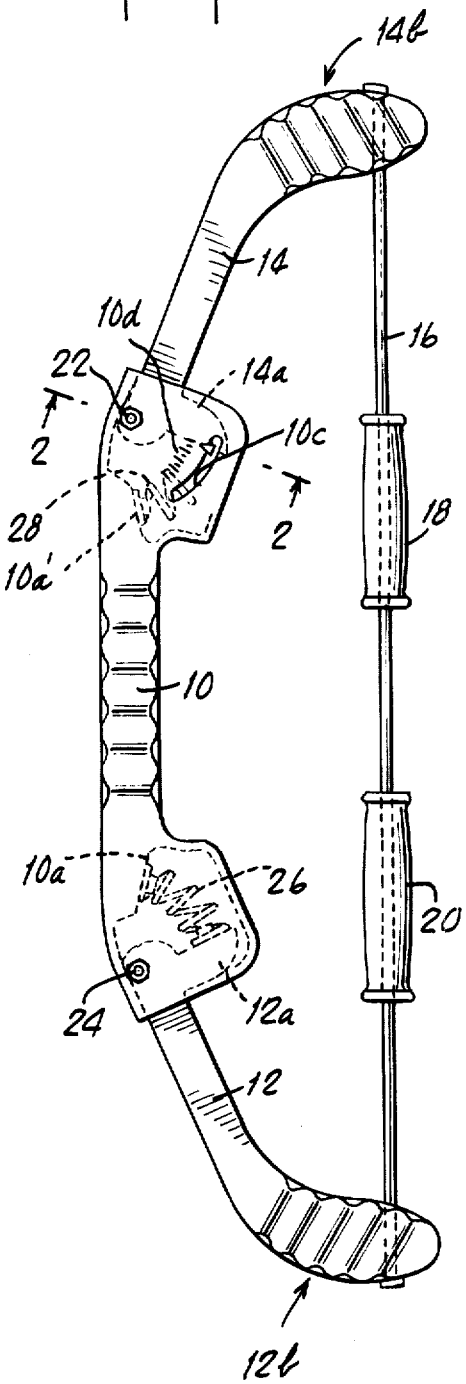
Fig. 2.
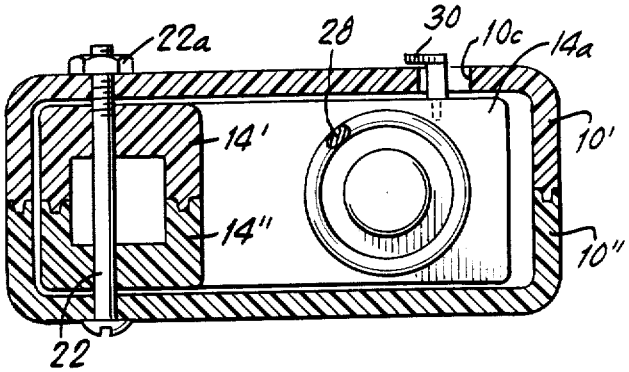
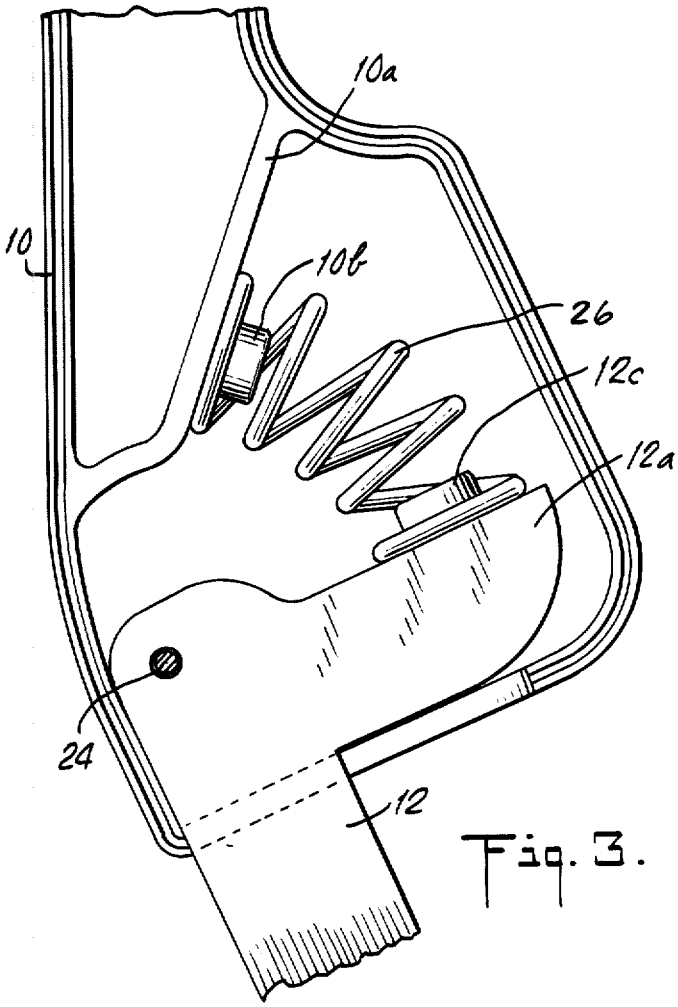
Fig. 3.

Fig. 4.
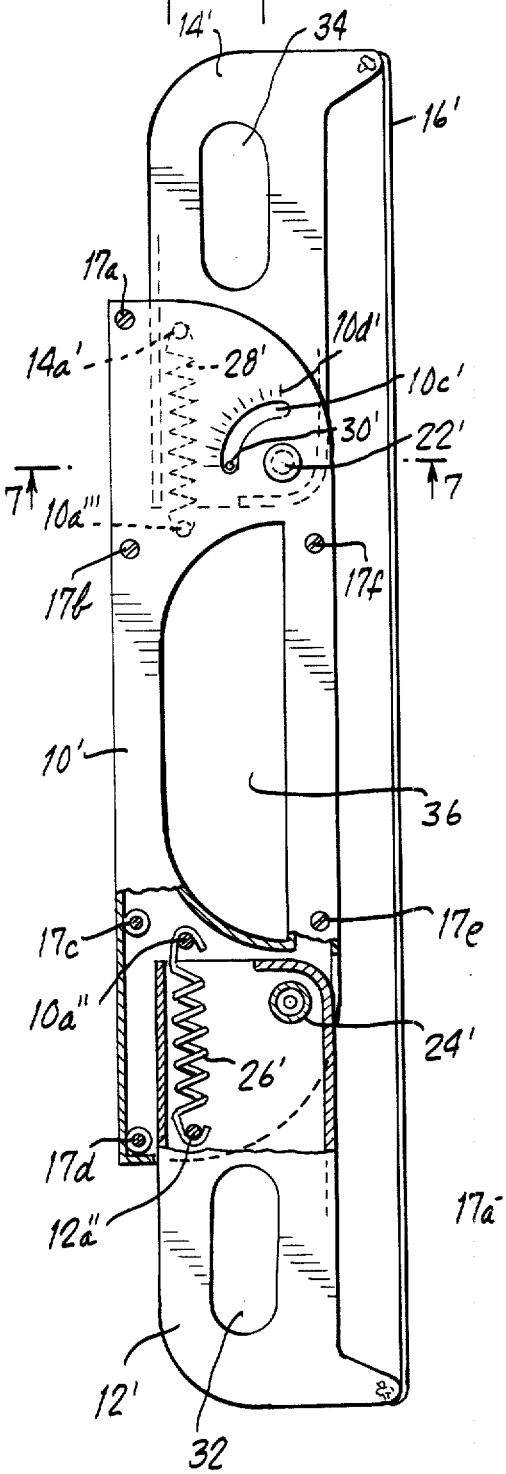
Fig. 5.
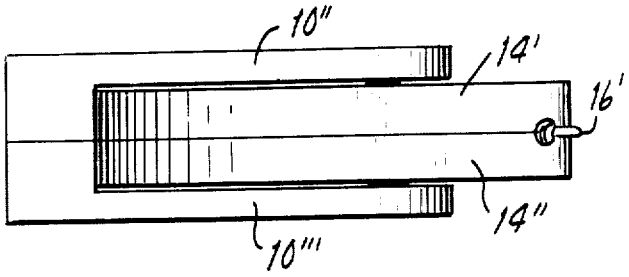
Fig. 6.
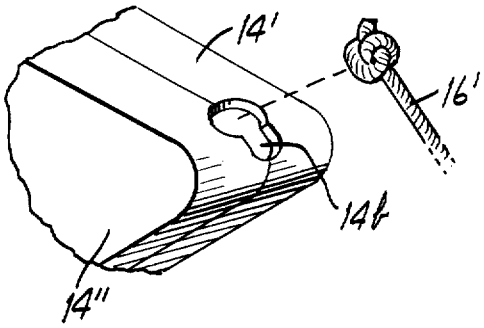
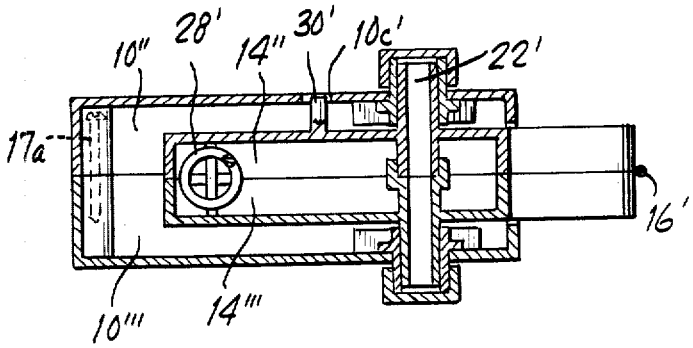
Fig. 7.

EXERCISER

REFERENCE TO A RELATED APPLICATION

This application is a continuation-in-part of parent application Ser. No. 901,183 filed on Apr. 28, 1978 (now abandoned) which is hereby incorporated by reference.

BACKGROUND AND SUMMARY OF THE INVENTION

The invention is in the field of exercising devices and is specifically directed to a device of this type which is inexpensive to make and is convenient to use.

Numerous exercisers of this general type have been proposed in the past. One example are exercisers using an elastic cord, such as illustrated in U.S. Pat. No. 4,059,265. Another is exercisers based on torsional action, such as illustrated in U.S. Pat. No. 3,510,130. Still another type is based on telescoping action using compression springs, such as illustrated in U.S. Pat. Nos. 3,268,225 and 3,971,255. Still another is based on scissors-type action using tension springs, as illustrated in U.S. Pat. No. 2,529,347. Some exercisers use indicators of the degree of force exerted in them, as suggested in U.S. Pat. Nos. 3,510,130 and 3,971,255.

The invention is directed to a different type of exerciser, one having a bow-like structure having two arms pivoted at the ends of a central bar and a cord connecting the free ends of the arms. A pair of sliding handles may be threaded on the cord, and a gauge indicating the degree of force exerted by the user may be provided at the pivotal connection of one of the arms to the central bar. The central bar and the free ends of the arms may be particularly adapted to be hand-grasped by the user, as by being formed with indentations fitting the fingers and palms of the user or by being formed with cutouts allowing the user to firmly hand-grasp the exerciser. The exerciser may be made primarily of inexpensive, molded plastic shells easily assembled by hand or with a minimum of tools.

A compression spring may be used to resist pivoting of the arms toward each other in one embodiment, and a tension spring may be used in another.

BRIEF DESCRIPTION OF THE DRAWINGS

FIG. 1 is a side, elevational view of an exerciser embodying the invention.

FIG. 2 is a cross section taken at lines 2—2 of FIG. 1.

FIG. 3 is an enlarged section of a detail of the exerciser.

FIG. 4 is a side, elevational view, showing an alternate embodiment of the invention.

FIG. 5 is a top view of the device of FIG. 4.

FIG. 6 is a fragmentary, perspective view of the device of FIG. 4.

FIG. 7 is a sectional view taken along line 7—7 of FIG. 4.

DETAILED DESCRIPTION

Referring to FIGS. 1–3, one embodiment of the exerciser comprises a bow-like structure having a central bar 10, a left arm 12, a right arm 14, and a cord 16 affixed to the free ends of the arms to connect them to each other. A pair of handles 18 and 20 may be slidably mounted on the cord 16. The right arm 14 is pivotally connected to the central bar 10 by means of a bolt 22 passing through suitable openings through the central bar 10 and the right arm 14 and secured by a nut 22*a*.

The left arm 12 is similarly pivotally connected to the central bar 10 by means of a similar bolt 24.

As seen in FIG. 1 at the connection of the left arm 12 and the central bar 10, and as seen in greater detail in FIG. 3, the left arm 12 has a foot 12*a* and there is a compression coil spring 26 secured at a peg 12*c* projecting from the foot 12*a* and at a support 10*a* which is a part of the central bar 10 and has a similar peg 10*b*. A similar compression coil spring 28 is secured between a similar foot 14*a* off the right arm 14 and a similar support 10*a*′ which is a part of the central bar 10, each of the support 10*a*′ and the foot 14*a* having a similar peg (not shown).

As seen in FIGS. 1 and 2, an indicator tab 30 is affixed to the foot 14*a* and extends through an arcuate opening 10*c* through the central bar 10 to indicate, on a scale 10*d* marked on the central bar 10 adjacent the opening 10*c*, the degree of pivoting of the arm 14 with respect to the central bar 10, and therefore the degree of force exerted by a user of the exerciser.

The exerciser may be used in a variety of ways to exercise different parts of the body. For example, the user may grasp the free ends of the arms 12 and 14 and force them toward each other. To facilitate such exercisers the free ends of the arms 12 and 14 are formed with respective hand grips at 12*b* and at 14*b* having indentations to fit the fingers and palm of the user. As another exercise the user may grasp the central bar 10 and may pull while restraining the cord 16 with his feet. To facilitate such exercisers the central portion of the central bar 10 is formed with hand grips having indentations to fit the fingers of the user. Of course, many other exercisers are possible.

The exerciser is made primarily of light-weight and inexpensive molded plastic material. As illustrated, for example, in FIG. 2, the central bar 10 comprises an upper shell 10′ and a lower shell 10″ which are molded independently but fit together as indicated to form the central bar 10. Similarly, the arms 12 and 14 may each be made of an upper shell and a lower shell which are molded independently, such as the upper shell 14′ and lower shell 14″ which fit together as illustrated in FIG. 2. Similarly, the handles 18 and 20 may be either unitary molded plastic pieces or may be each made of two molded halves with suitable interlocks to fit together. The cord 16 may be, for example, a length of mountain-climbing nylon rope.

An alternate embodiment of the invented exerciser device is illustrated in FIGS. 4–7. This embodiment comprises a central bar 10′, a left arm 12′, a right arm 14′, and a cord 16′ affixed to the free ends of the arms 12′ and 14′ to connect them to each other. The right arm 14′ is pivotally connected to the central bar 10′ by means of a bolt 22′ passing through suitable openings through the central bar 10′ and the right arm 14′. The left arm 12′ is similarly pivotally connected to the central bar 10′ by means of a similar bolt 24′.

As seen in FIG. 4, at the connection of the left arm 12′ and the central bar 10′, there is a tension coil spring 26′ secured at peg 12*a*′ which is a part of the left arm 12′ and at a similar peg 10*a*″ which is a part of the central bar 10′. A similar tension coil spring 28′ is secured between a similar peg 14*a*′ which is a part of the right arm 14′ and a similar peg 10*a*′ which is a part of the central bar 10′.

As seen in FIGS. 4 and 7, an indicator tab 30′ is affixed to the right arm 14′ and extends through an arcuate opening 10c' through the central bar 10' to indicate, on a scale 10d' marked on the central bar 10' adjacent to the opening 10c', the degree of pivoting of the arm 14' with respect to the central bar 10', and therefore the degree of force exerted by a user of the exerciser.

The exerciser of FIGS. 4–7 may be used in a variety of ways to exercise different parts of the body. For example, the user may grasp the free ends of the arms 12' and 14' and force them toward each other. To facilitate such exercisers the arms 12' and 14' may be particularly adapted to be hand-grasped by the user—by having oval shaped cutouts 32 and 34 in them, large enough to allow the user's hand to grasp the arms 12' and 14' through the respective cutouts 32 and 34. In another exercise the user may grasp the central bar 10' and one of the arms 12' or 14' and pull one of the arms 12' or 14' toward the other arm while grasping the central bar 10'. To facilitate such exercisers the central bar may also be particularly adapted to be hand-grasped by the user—by having at its center an oval shaped cutout 36 large enough to allow the user to grasp the central bar. The cord 16' may also have sliding handles (not shown) similar to the handles 18 and 20 in FIG. 1.

The cutout 36 in the central bar 10' is large enough and is shaped to be adapted to a type of a rowing exercise in which the user can place his foot or feet in the cutout 36 and pull the arms 10a and 12a toward each other in a rowing motion. As another exercise a user may have his feet or at least toes in the cutouts 32 and 34 in the arms 12' and 14' respectively while pulling with his hands on the central bar 10' to thereby pivot the arms 12' and 14' toward each other in a somewhat similar rowing motion.

It is noted that the arms of each of the embodiments of the exerciser are independently sprung so that the device can be used in exercises which require only one of the arms to be pivoted relative to the central bar. It is also noted that the cord is not required for certain exercises and for that reason it is easily removable, at least from the embodiment shown in FIGS. 4–7. With the cord removed, the exerciser is still generally bow-shaped but does not work as a bow having a string.

The exerciser of FIGS. 4–7 is also made primarily of light-weight and inexpensive molded plastic material. As illustrated in FIG. 7, the central bar 10' comprises an upper shell 10'' and a lower shell 10''' which are molded independently and secured together by suitable means such as bolts 17a through 17f. Similarly, the arms 12' and 14' may each be made of an upper shell and lower shell which are molded independently, such as the upper shell 14'' and lower shell 14''' which fit together as is illustrated in FIG. 7. The cord 16', as best illustrated in FIG. 6, is attached to arms 12' and 14' by fitting a cord knot in key holes 12b (not shown) and 14b. The cord may be, for example, a length of mountain-climbing nylon rope.

What is claimed is:

1. An exerciser comprising a bow-like structure including a central bar having a left and a right end, a left arm having a free end and an end connected pivotally to the left end of the central bar, a right arm having a free end and an end connected pivotally to the right end of the central bar, a cord connecting the free ends of the arms to each other and resilient means connected to the arms to resist pivoting of the arms toward each other, the free ends of the arms being formed into hand-grasp means particularly adapted to be hand-grasped by a user, whereby in use of the exerciser the free ends of the arms may be moved toward each other against the force of the resilient means by exerting force directly on the arms to move them toward each other and/or by exerting force directly on the cord and/or the central bar so as to similarly move the arms toward each other, in which the gauge comprises a cutout in one end of the central bar and one of the arms and a tab mounted on the other end of said central bar and one of the arms and extending through said cutout to move relative thereto upon pivoting of the last recited central bar and arm.

* * * * *